US006497788B1

(12) United States Patent
Prechtel et al.

(10) Patent No.: US 6,497,788 B1
(45) Date of Patent: Dec. 24, 2002

(54) BACKWATER CYCLE AND PROCESS FOR THE WATER CIRCULATION OF A PAPER MACHINE

(75) Inventors: Klaus Prechtel, Heidenheim (DE); Ingolf Cedra, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/570,376

(22) Filed: May 12, 2000

(30) Foreign Application Priority Data

May 14, 1999 (DE) ..... 199 22 391

(51) Int. Cl.[7] ..... D21F 1/66

(52) U.S. Cl. ..... 162/190; 162/264; 162/186; 162/335

(58) Field of Search ..... 162/189, 190, 162/264, 252, 253, 183, 184, 185, 186, 126, 127, 128, 266, 335, 337, 322

(56) References Cited

U.S. PATENT DOCUMENTS

| | | | | |
|---|---|---|---|---|
| 1,950,351 A | * | 3/1934 | Clark et al. | 118/410 |
| 5,152,872 A | * | 10/1992 | Racine et al. | 162/184 |
| 5,567,278 A | | 10/1996 | Meinander | 162/190 |
| 5,639,349 A | * | 6/1997 | Begemann et al. | 162/190 |

FOREIGN PATENT DOCUMENTS

| | | | | |
|---|---|---|---|---|
| DE | 3406808 | | 9/1985 | D21F/7/00 |
| DE | 34 06 808 | * | 9/1985 | D21F/7/00 |
| FR | 1341327 | | 1/1964 | |
| WO | 91/10500 | | 7/1991 | B01D/61/14 |
| WO | 93/23612 | | 11/1993 | D21F/1/66 |

OTHER PUBLICATIONS

Smook, G. A., Handbook for Pulp & Paper Technologists, Angus Wilde Publications (1992), pp. 247–248.*

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Backwater cycle of and process for circulating water in a paper machine having a wet zone. The backwater cycle includes at least one application device arranged to apply a composition containing at least one of pigment and filler onto a fiber web in the wet zone, a first backwater cycle that supplies a stock inlet with backwater removed from the production process upstream, relative to a web travel direction, of the at least one application device, and a second backwater cycle that accepts a remainder of the backwater. The process includes extracting backwater from the fiber web, and feeding backwater, which is not charged with the at least one of pigments and fillers, to a stock inlet.

31 Claims, 1 Drawing Sheet

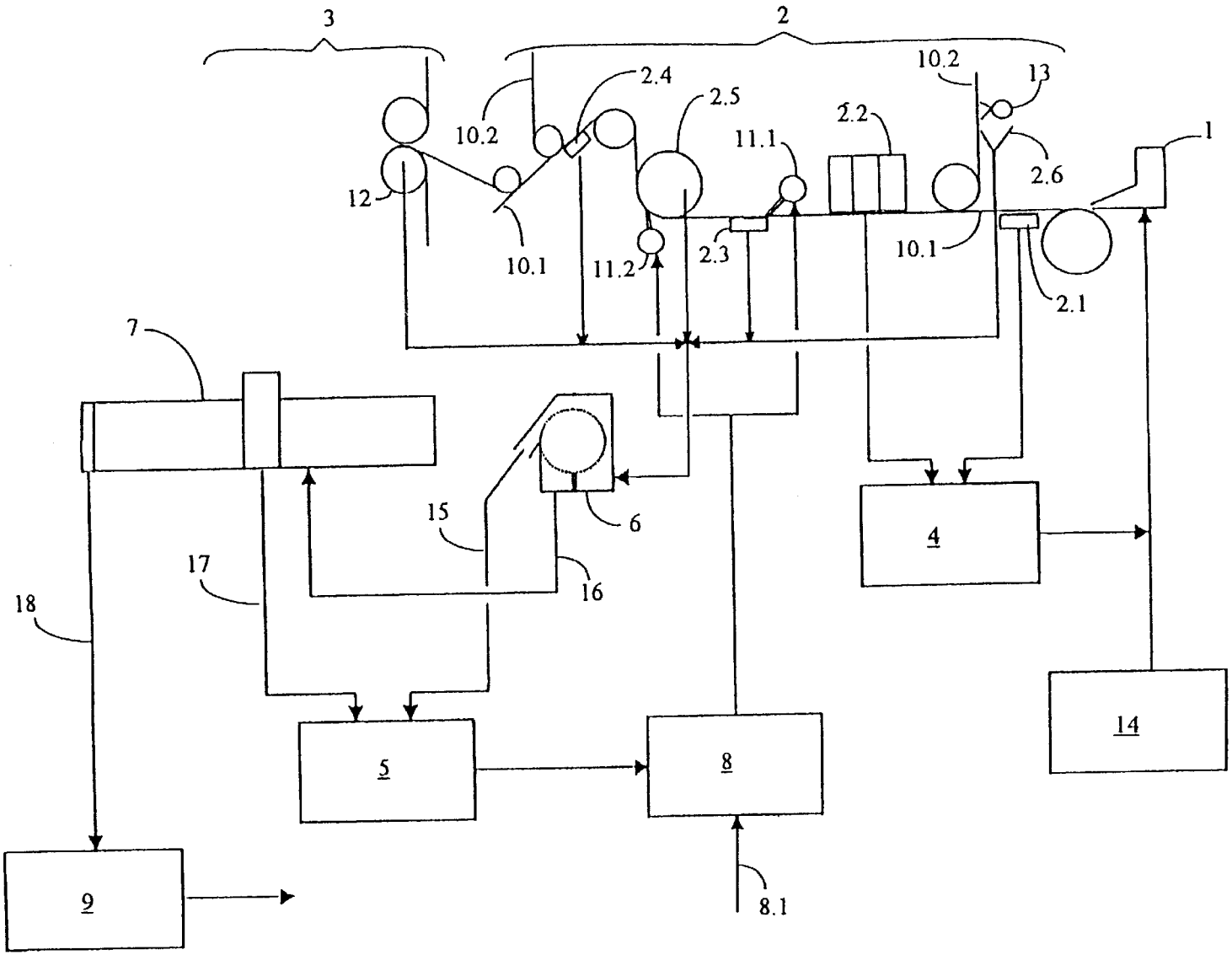
1
2
3
2.1
2.2
2.3
2.4
2.5
2.6
10.1
10.2
11.1
11.2
12
13
14
4
5
6
7
8
8.1
9
15
16
17
18

BACKWATER CYCLE AND PROCESS FOR THE WATER CIRCULATION OF A PAPER MACHINE

CROSS-REFERENCE TO RELATED APPLICATIONS

The present application claims priority under 35 U.S.C. §119 of German Patent Application No. 199 22 391.2, filed on May 14, 1999, the disclosure of which is expressly incorporated by reference herein in its entirety.

BACKGROUND OF THE INVENTION

1. Field of the Invention

The present invention relates to a backwater cycle of a paper machine that has at least one application device for applying a composition containing pigment and/or filler onto a fiber web that has not yet been completely dewatered in the wet zone. The backwater cycle includes a first backwater cycle that supplies a stock inlet with backwater, and a second backwater cycle that forms the remainder of the backwater cycle. The present invention further relates to a process for circulating water of a paper machine having a wet zone in which a composition containing pigment and/or filler is applied onto at least one surface of a fiber web being formed, and backwater is extracted from the fiber web being formed.

2. Discussion of Background Information

It is known from U.S. Pat. No. 5,152,872 to apply a pigment or filler onto a paper web that has not yet been completely dewatered, in order to produce thereby a multi-layer paper whose outer layers have a pigment content considerably higher than that of the inner layer.

When such a pigment application or filler application technique is used in a conventional paper machine on a paper web that has not yet been completely dewatered, a problem arises that, after the paper machine has been running for a certain time, the wire cycle in which the stock inlet is included becomes enriched with filler or pigment. The result of such an enrichment is that the inner paper layer, which is initially low-filler, becomes likewise enriched with filler or pigments as the production process continues. This result runs counter to the desired distribution of the filler in the paper. In fact, an advantageous filler distribution in the paper is considered to be a state in which the filler or the pigments are essentially situated in the outer layers of the paper, while the inner layer is chiefly loaded with fiber components in order to achieve a high breaking strength. The chief advantage of such a steep filler distribution in the paper is the leveling of the surface structure that is decisive for the printing process, and homogenization thereof.

SUMMARY OF THE INVENTION

The present invention provides a backwater cycle of a paper machine and a process for circulating water of a paper machine that prevents the inner layer of the produced paper from being enriched with filler and/or pigment, even when the paper machine has been operated for a lengthy period.

During the paper production process, the amounts of water removed in a wire section of the paper machine are separated into two fractions, backwater I and backwater II. In modern paper machines, backwater I refers to the part of the backwater that accumulates on a forming roll, an upper wire suction box, a forming shoe, and/or other suction elements, in which the possibility of an upstream application of filler and/or pigment is not being taken into consideration. Backwater I is conducted in a short cycle without treatment and is utilized for thinning the slush of a machine vat immediately upstream of the stock inlet.

The water that accumulates at the wet suction elements, flat suction elements, and suction wire rolls are typically collected as backwater II. The clear water is then used for spray pipes and the like.

However, when filler and/or pigment is applied in the wire section of a paper machine, a portion of the applied filler and/or pigment can be removed by a subsequent vacuum suction element. Thus, re-using such water without intermediate treatment causes the thin pulp, which is initially distributed in a crosswise manner by the stock inlet and dewatered via a forming roll and wire suction box, to be enriched with filler and/or pigment. It is not possible to adjust a very steep filler distribution in the Z direction of the paper.

Therefore, in order to solve the above-described problem, the backwater cycle of a paper machine and the process for water circulation of the paper machine can be designed so that the water cycle in which the stock inlet of the paper machine is included is loaded from dewatering units that dewater the fiber web at a stage at which no composition containing pigment and/or filler has been applied onto the fiber web that is being formed. Each dewatering element that extracts moisture from the web subsequent to the application of filler and/or pigments can be consequently enriched with high pigment or filler components, so that this water would lead to a constant increase in the filler and/or pigment content of the layer formed by the stock inlet. Other units which would be undesirable to use for delivering backwater to the stock inlet include devices for catching cleaning liquid for wires which have come into contact with the pigment and/or filler application. This is because these wires are likewise charged with an increased filler and/or pigment content.

Thus, the present invention develops a backwater cycle of a paper machine that has at least one application device for applying a composition containing pigment and/or filler onto a fiber web that has not yet been completely dewatered in the wet zone. The backwater cycle includes a first backwater cycle that supplies a stock inlet with backwater and a second backwater cycle that accepts the remainder of the backwater. In this manner, the first backwater cycle is fed exclusively by dewatering elements that are arranged in the production process upstream, relative to a wire travel direction, of the application of a composition containing pigment and/or filler.

In this manner, the first backwater, which is returned to the stock inlet, is charged with lower or substantially lower filler concentrations or pigment concentrations than the pulp suspension that is fed to the stock inlet. This avoids the problem of the first backwater cycle, in which the stock inlet is included, being increasingly enriched with filler and/or pigment. Finally, in this way, a high portion of pigment and/or filler can be present in the outer layers of the produced paper web, while the fiber component maintains a constantly high value in the inner layer, and while the filler and/or pigment portion remains low.

The advantageous design of the backwater cycle of the present invention includes that the backwater of the second backwater cycle serves to feed the application of the composition containing pigment and/or filler. Since the second backwater cycle of the invention is fed at least chiefly by units that deliver water with a high pigment and/or filler content, this cycle is particularly well-suited to serve the water cycle for the applicator or applicators of the pigment and/or filler-containing composition.

It may furthermore be advantageous for the remaining backwater of the second backwater cycle, which is not being used to feed the application of the composition containing pigment and/or filler, to be processed with a depulping device, e.g., a microflotation device, to produce a clear filtrate. The clear filtrate formed from the second backwater cycle can be used later at any desired point in the production process of the paper web.

The presence of a depulping device, e.g., a microflotation device, is particularly advantageous when the backwater of the second backwater cycle is provided with a binder, e.g., starch, since this binder can then be carried out from the backwater by the depulping device and thereby avoid an enrichment of binder in the middle fiber layer of the finished paper.

Moreover, it is advantageous to introduce a disk decker upstream of a microflotation device, since a considerable portion of the remaining substances is removed from the backwater and the necessary filter area of the microflotation device can be reduced at the same water flow-through amount, thereby reducing costs.

It is also advantageous when a microflotation device and, optionally, a disk decker are present if the part of the backwater that is fed to the application of the composition containing pigment and/or filler is removed from the flotate of the microflotation device and/or from the overflow of the disk decker. This ensures that the portion of the pigment and/or filler-containing backwater that is provided with a higher pigment and/or filler content is fed to the application and, thus, leads to the maximum possible return of pigment and/or filler.

Moreover, according to the process of the instant invention for water circulation of a paper machine having a wet zone in which a composition containing pigment and/or filler is applied onto at least one surface of a fiber web being formed. Backwater is extracted from the fiber web being formed, so that the backwater that is not charged with pigments and/or fillers from the pigment and/or filler application is fed to the stock inlet.

Another result is that the inner fiber web of the finished paper is not enriched with filler and/or pigments and, in this manner, the breaking strength of the finished paper gains a constantly high value, even after lengthy production times.

An advantageous embodiment of the process provides that backwater charged with pigments and/or fillers from the pigment and/or filler application is fed to the application of the composition containing pigment and/or filler.

Moreover, it is advantageous to process the remaining backwater, which is not being used to feed the application of the composition containing pigment and/or filler and which is not fed to the stock inlet, with a depulping device, e.g., a microflotation device, to produce a clear filtrate and, optionally, to return it into the production process. The clear filtrate can be returned to the paper machine at any desired point.

If binder is present in the backwater of the second backwater cycle, the above explanations apply.

It is likewise advantageous to design the process so that a pre-cleaning by a disk decker takes place upstream of a microflotation device. This causes a reduction in the filter area needed in the microflotation device and, thus, a reduction in the cost of the process.

A further advantageous design of the process provides for the backwater fed to the application of the composition containing pigment and/or filler to be removed from the overflow of the microflotation device and/or the optionally present disk decker. The effect of this process design is that exclusively the high-content portion of the backwater is fed into the return to the application, and, thus, the amount of new pigment and/or filler needed can be reduced. Of course, the features of the invention described above and to be explained below can be used not only in the combinations provided, but also in other combinations or alone, without leaving the framework of the invention.

The present invention is directed to a backwater cycle of a paper machine having a wet zone. The backwater cycle includes at least one application device arranged to apply a composition containing at least one of pigment and filler onto a fiber web in the wet zone, a first backwater cycle that supplies a stock inlet with backwater removed from the production process upstream, relative to a web travel direction, of the at least one application device, and a second backwater cycle that accepts a remainder of the backwater.

In accordance with a feature of the invention, the at least one application device can be arranged to apply the composition to the fiber web while it is not completely dewatered. Dewatering devices can be provided so that the first backwater cycle can include first backwater removed exclusively by dewatering devices located upstream of the at least one application device.

According to another feature of the present invention, a first portion of the remainder backwater may be supplied to the at least one application device. Further, a depulper can be provided, so that a second portion of the remainder backwater can be produced in the depulper as a clear filtrate. The depulper can include a microflotation device. Still further, a disk decker can be arranged upstream of the depulping device. The depulper can be a microflotation device, and the first portion of the remainder backwater can include at least one of an overflow from the disk decker and flotate of the microflotation device.

In accordance with still another feature of the invention, upstream dewatering elements may be located upstream of the at least one application device. The first backwater cycle can include first backwater removed by the upstream dewatering elements. The first backwater can be removed exclusively by the upstream dewatering elements. Further, downstream dewatering elements may be located downstream of the at least one application device, such that the remaining backwater can include second backwater removed by the downstream dewatering elements. The second backwater can be removed exclusively by the downstream dewatering elements. Moreover, the paper machine may include at least one forming wire, and the backwater cycle can further include a cleaning liquid collector arranged to collect cleaning liquid applied to the at least one forming wire. The remaining backwater can include the collected cleaning liquid.

The invention is directed to a process for circulating water in a paper machine having a wet zone and at least one application device for applying a composition containing at least one of pigment and filler onto at least one surface of a fiber web being formed. The process includes extracting backwater from the fiber web, and feeding backwater, which is not charged with the at least one of pigments and fillers, to a stock inlet.

According to a feature of the invention, the process can also include exclusively feeding backwater, which is not charged with the at least one of pigments and fillers, to a stock inlet.

The process can also include feeding backwater, which is charged with the at least one of pigments and fillers, to the at least one application device. Further, the process can include exclusively feeding backwater, which is charged with the at least one of pigments and fillers, to the at least one application device. The backwater fed to the at least one application device can include cleaning liquid used for cleaning forming wires of the paper machine.

Moreover, the process may include processing a portion of the backwater, which is charged with at least one of pigments and fillers, in a depulping device to produce a clear filtrate. The depulping device can be a microflotation device. The process can also include preliminarily cleaning the portion of backwater in a disk decker located upstream, relative to a web travel direction of the microflotation device. Further, the process can include feeding backwater from at least one of the overflow of the disk decker and the flotate of the microflotation device to the at least one application device.

The present invention is also directed to an apparatus for forming a fiber web that includes at least one application device arranged to apply a composition containing at least one of pigment and filler onto a fiber web in the wet zone, at least one upstream dewatering device, located upstream, relative to a web travel direction, of the at least one application device, adapted to remove a first backwater from the fiber web, and a stock inlet coupled to the at least one upstream dewatering device, and adapted to receive the first backwater. At least one downstream dewatering device, located downstream of the at least one application device, is adapted to remove a second backwater charged with the at least one of pigment and filler, and at least a first portion of the second backwater is coupled to the at least one application device.

According to a feature of the invention, the apparatus can include a depulper, such that a second portion of the second backwater can be produced in the depulper produce as a clear filtrate. The depulper can be a microflotation device. Further, a disk decker can be arranged upstream of the depulping device. Still further, the first portion of the remainder backwater can include at least one of an overflow from the disk decker and flotate of the microflotation device.

The present invention is directed to a process for circulating water in a paper machine having a wet zone and at least one application device for applying a composition containing at least one of pigment and filler onto at least one surface of a fiber web being formed. The process can include extracting a first backwater which is not charged with the at least one of pigments and fillers, and feeding the extracted first backwater to a stock inlet.

According to yet another feature of the invention, the process can include extracting a second backwater which is charged with the at least one of pigments and fillers, and feeding a portion the extracted second backwater to the at least one application device. A remaining portion of the extracted second backwater can be a clear filtrate. The first backwater and the second backwater can be exclusive of each other.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted exemplary embodiment of the present invention, wherein:

The FIGURE schematically illustrates a backwater cycle of the paper machine in accordance with an exemplary embodiment of the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The FIGURE schematically illustrates a backwater cycle of a paper machine according to the instant invention. In particular, the parts of the paper machine that are depicted include a sheet-forming section 2 with an upstream stock inlet 1 and a press section 3 located downstream, relative to a sheet travel direction. The backwater flows are indicated by arrows.

The FIGURE depicts a former, e.g., a hybrid former, with stock inlet 1 arranged to deliver a pulp suspension from a pulp processing unit 14 onto a first wire 10.1. A first dewatering unit 2.1 is positioned to collect backwater and to forward the same to a backwater container 4 is provided directly adjacent thereto. A second wire 10.2 can be arranged to be laid onto the suspension layer from above, and a further dewatering element 2.2 can be positioned on an upper side of wire 10.2 to remove backwater and forward the same to backwater container 4. Dewatering units 2.1 and 2.2, both of which are positioned upstream, relative to the sheet travel direction, of a subsequent application of pigment and/or filler, produce "backwater I" and serve, e.g., exclusively, the backwater cycle which includes stock inlet 1.

Adjacent and downstream of dewatering element 2.2, pigment and/or filler can be applied onto the forming web. In particular, a first applicator 11.1 may be positioned immediately adjacent dewatering element 2.2 to apply the pigment and/or filler through wire 10.2 onto the web being formed. A further dewatering element 2.3 is positioned adjacent wire 10.1 and the surface of the web being formed which is opposite the surface on which the pigment and/or filler was applied. Wires 10.1 and 10.2, as well as the forming web, are guided around a wire suction roll 2.5, which is also utilized as another dewatering element. A second applicator 11.2 can be arranged to deliver pigment and/or filler through wire 10.1 onto the surface of the web being formed adjacent wire 10.1. Second applicator 11.2 is arranged to apply the pigment and/or filler while the web being formed is being guided over a circumferential portion of wire suction roll 2.5, and wire 10.2 is in contact with wire suction roll 2.5. The fiber web sandwiched between wires 10.1 and 10.2 is then guided over a guide roll and over another dewatering element 2.4. After dewatering element 2.4, upper wire 10.2 detaches itself from the fiber web and the web is conducted on wire 10.1 and subsequently deflected toward press section 3.

At a beginning of press section 3, a suction roll 12 is mounted to provide additional dewatering of the fiber web and to carry away the removed backwater, which is loaded with pigment and/or filler. According to the invention, the "backwater II" formed in this way, which has been removed from dewatering units 2.3, 2.4, 2.5, and 12 is collected and conducted jointly to a disk decker 6 and, thus, is kept away from the cycle of backwater I of stock inlet 1.

Further, cleaning water, which is caught in a collection vessel 2.6 is fed to backwater II and conducted to disk decker 6, since this cleaning water contains a high proportion of pigments and/or fillers.

Disk decker 6 delivers its thin pulp via a line 16 to a microflotation device 7 and its slush pulp via a line 15 to a backwater container 5. Further, flotate from microflotation device 7 is also conducted to backwater container 5 via a line 17. From backwater container 5, a pigment and/or filler processing 8 is fed with water whose content of pigment and filler is high, into which a necessary amount of fresh pigment and/or filler can be fed via inlet 8.1.

Pigment and/or filler processing 8 then forwards the prepared pigment and/or filler slurry to applicators 11.1 and 11.2, so as to be applied onto the forming fiber web.

The clear filtrate that accumulates from microflotation 7 is stored in a clear filtrate container 9 via a line 18 and is available for the paper production process as clear water to be used again as desired and at any point.

It should additionally be pointed out that it is within the scope of the invention for a binder to be added to the pigment and/or filler, e.g., to produce an offset-quality paper. The above-mentioned advantages also apply here with respect to the avoidance of the enrichment of binder in the middle fiber layer of the finished paper.

Therefore, the effect of the above-described backwater cycle of a paper machine and the process for water circulation in a paper machine is that an enrichment of the inner layer of the produced paper with filler and/or pigment is avoided, even during lengthy operation of the paper machine.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 Stock inlet
2 Sheet-forming section
2.1–2.5 Dewatering elements
2.6 Collection device for cleaning water
3 Press section
4 Backwater container
5 Backwater container
6 Disk decker
7 Microflotation device
8 Pigment and filler processing
8.1 Feed
9 Clear filtrate container
10.1 First wire
10.2 Second wire
11.1 First applicator
11.2 Second applicator
12 Suction roll
13 Wire cleaning device
14 Line for pulp processing
15 Line for slush pulp of the disk decker
16 Line for thin pulp of the disk decker
17 Line for flotate
18 Line for clear filtrate

What is claimed is:

1. A process for circulating water in a paper machine having a wet zone and at least one application device for applying a composition containing at least one of pigment and filler onto at least one surface of a fiber web being formed, the process comprising:

extracting backwater from the fiber web; and exclusively feeding backwater, which is not charged with the at least one of pigments and fillers, to the stock inlet.

2. A process for circulating water in a paper machine having a wet zone and at least one application device for applying a composition containing at least one of pigment and filler onto at least one surface of a fiber web being formed, the process comprising:

extracting backwater from the fiber web; and feeding backwater, which is not charged with the at least one of pigments and fillers, to a stock inlet, wherein the backwater includes water removed from both sides of the web in the wet zone and upstream of the at least one application device.

3. The process in accordance with claim 2, further comprising:

feeding backwater, which is charged with the at least one of pigments and fillers, to the at least one application device.

4. The process in accordance with claim 3, further comprising exclusively feeding backwater, which is not charged with the at least one of pigments and fillers, to the at least one application device.

5. The process in accordance with claim 4, wherein the backwater fed to the at least one application device includes cleaning liquid used for cleaning forming wires of the paper machine.

6. A process for circulating water in a paper machine having a wet zone and at least one application device for applying a composition containing at least one of pigment and filler onto at least one surface of a fiber web being formed, the process comprising:

extracting backwater from the fiber web;

feeding backwater, which is not charged with the at least one of pigments and fillers, to a stock inlet; and processing a portion of the backwater, which is charged with at least one of pigments and fillers, in a depulping device to produce a clear filtrate.

7. The process in accordance with claim 6, wherein the depulping device comprises a microflotation device.

8. The process in accordance with claim 7, further comprising preliminarily cleaning the portion of backwater in a disk decker located upstream, relative to a web travel direction of the microflotation device.

9. The process in accordance with claim 8, further comprising:

feeding backwater from at least one of an overflow of the disk decker and a flotate of the microflotation device to the at least one application device.

10. A process for circulating water in a paper machine having a wet zone and at least one application device for applying a composition containing at least one of pigment and filler onto at least one surface of a fiber web being formed, the process comprising:

extracting a first backwater which is not charged with the at least one of pigments and fillers; and feeding the extracted first backwater to a stock inlet, wherein the first backwater is removed from both sides of the web in the wet zone and upstream of the at least one application device.

11. The process in accordance with claim 10, further comprising:

extracting a second backwater which is charged with the at least one of pigments and fillers; and feeding a portion the extracted second backwater to the at least one application device.

12. The process in accordance with claim 11, wherein a remaining portion of the extracted second backwater is a clear filtrate.

13. The process in accordance with claim 11, wherein the first backwater and the second backwater are exclusive of each other.

14. A backwater cycle of a paper machine having a wet zone, the backwater cycle comprising:

at least one application device arranged to apply a composition containing at least one of pigment and filler onto a fiber web in the wet zone;

a first backwater cycle that supplies a stock inlet with backwater removed from a production process upstream, relative to a web travel direction, of the at least one application device; and a second backwater cycle that accepts a remainder of the backwater, wherein the first backwater cycle includes backwater removed from both sides of the web in the wet zone and upstream of the at least one application device.

15. The backwater cycle in accordance with claim 14, wherein said at least one application device is arranged to apply the composition to the fiber web while it is not completely dewatered.

16. The backwater cycle in accordance with claim 15, further comprising:

dewatering devices, wherein said first backwater cycle comprises first backwater removed exclusively by dewatering devices located upstream of said at least one application device.

17. The backwater cycle in accordance with claim 14, wherein a first portion of said remainder backwater is supplied to said at least one application device.

18. The backwater cycle in accordance with claim 17, further comprising:

a depulper, wherein a second portion of the remainder backwater is produced in said depulper as a clear filtrate.

19. The backwater cycle in accordance with claim 18, wherein said depulper comprises a microflotation device.

20. The backwater cycle in accordance with claim 17, further comprising a disk decker arranged upstream of said depulping device.

21. The backwater cycle in accordance with claim 20, wherein said depulper comprises a microflotation device, and wherein said first portion of the remainder backwater comprises at least one of an overflow from said disk decker and flotate of said microflotation device.

22. The backwater cycle in accordance with claim 14, further comprising:

upstream dewatering elements located upstream of said at least one application device, wherein said first backwater cycle comprises first backwater removed by said upstream dewatering elements.

23. The backwater cycle in accordance with claim 22, wherein said first backwater is removed exclusively by said upstream dewatering elements.

24. The backwater cycle in accordance with claim 22, further comprising:

downstream dewatering elements located downstream of said at least one application device, wherein said remaining backwater comprises second backwater removed by said downstream dewatering elements.

25. The backwater cycle in accordance with claim 24, wherein said second backwater is removed exclusively by said downstream dewatering elements.

26. The backwater cycle in accordance with claim 24, wherein the paper machine includes at least one forming wire, and the backwater cycle further comprising a cleaning liquid collector arranged to collect cleaning liquid applied to the at least one forming wire, wherein said remaining backwater comprises the collected cleaning liquid.

27. An apparatus for forming a fiber web comprising:

at least one application device arranged to apply a composition containing at least one of pigment and filler onto a fiber web in a wet zone;

at least one upstream dewatering device, located upstream, relative to a web travel direction, of said at least one application device, adapted to remove a first backwater from the fiber web;

a stock inlet coupled to said at least one upstream dewatering device, and adapted to receive said first backwater;

at least one downstream dewatering device, located downstream of said at least one application device, adapted to remove a second backwater charged with said at least one of pigment and filler, wherein at least a first portion of said second backwater is coupled to said at least one application device, wherein the first backwater is removed from both sides of the web in the wet zone and upstream of the at least one application device.

28. An apparatus for forming a fiber web comprising:

at least one application device arranged to apply a composition containing at least one of pigment and filler onto a fiber web in a wet zone;

at least one upstream dewatering device, located upstream, relative to a web travel direction, of said at least one application device, adapted to remove a first backwater from the fiber web;

a stock inlet coupled to said at least one upstream dewatering device, and adapted to receive said first backwater;

at least one downstream dewatering device, located downstream of said at least one application device, adapted to remove a second backwater charged with said at least one of pigment and filler, at least a first portion of said second backwater being coupled to said at least one application device; and a depulper, wherein a second portion of said second backwater is produced in said depulper produce as a clear filtrate.

29. The backwater cycle in accordance with claim 28, wherein said depulper comprises a microflotation device.

30. The backwater cycle in accordance with claim 28, further comprising a disk decker arranged upstream of said depulper.

31. The backwater cycle in accordance with claim 30, wherein said depulper comprises a microflotation device, and wherein said first portion of the remainder backwater comprises at least one of an overflow from said disk decker and flotate of said microflotation device.

* * * * *